US006044679A

United States Patent [19]

Meijer

[11] Patent Number: 6,044,679

[45] Date of Patent: Apr. 4, 2000

[54] METHOD FOR MACHINING METAL PLATE

[76] Inventor: Sjoerd Meijer, Oude Bildtdijk 894, NL-9079 NG St Jacobiparochie, Netherlands

[21] Appl. No.: 09/155,555

[22] PCT Filed: Mar. 25, 1997

[86] PCT No.: PCT/NL97/00150

§ 371 Date: Mar. 4, 1999

§ 102(e) Date: Mar. 4, 1999

[87] PCT Pub. No.: WO97/36702

PCT Pub. Date: Oct. 9, 1997

[30] Foreign Application Priority Data

Apr. 1, 1996 [NL] Netherlands ..... 1002757
Oct. 4, 1996 [NL] Netherlands ..... 1004193

[51] Int. Cl.[7] ..... B21D 17/04

[52] U.S. Cl. ..... 72/179; 72/182; 413/17; 83/885

[58] Field of Search ..... 72/325, 250, 179, 72/182, 210; 413/17, 55; 83/885, 886

[56] References Cited

U.S. PATENT DOCUMENTS

| | | | |
|---|---|---|---|
| 3,333,451 | 8/1967 | Inlow | 72/250 |
| 3,359,773 | 12/1967 | Stuchbery | 72/325 |
| 4,552,002 | 11/1985 | Haenni | 72/21.4 |
| 4,918,956 | 4/1990 | Schoch | 72/21.4 |
| 5,138,857 | 8/1992 | Siegert | 72/21.4 |
| 5,555,759 | 9/1996 | Rosene | 72/179 |
| 5,575,168 | 11/1996 | Rosene | 72/179 |

*Primary Examiner*—Daniel C. Crane
*Attorney, Agent, or Firm*—Mark Zovko

[57] ABSTRACT

The present invention relates to a method for forming weakenings in a metal plate (8), comprising of: deforming the metal plate to a predetermined depth to form a weakening thinned portion along at least one line; and bending the metal plate along the line, characterized by displacing relative to each other the metal plate and at least one tool deforming the metal plate along the line and over at least one surface of the metal plate with a force directed substantially transversely of the metal plate and sufficient to deform the metal plate. The invention also relates to a device for performing thereof.

15 Claims, 4 Drawing Sheets

METHOD FOR MACHINING METAL PLATE

Figure 1:
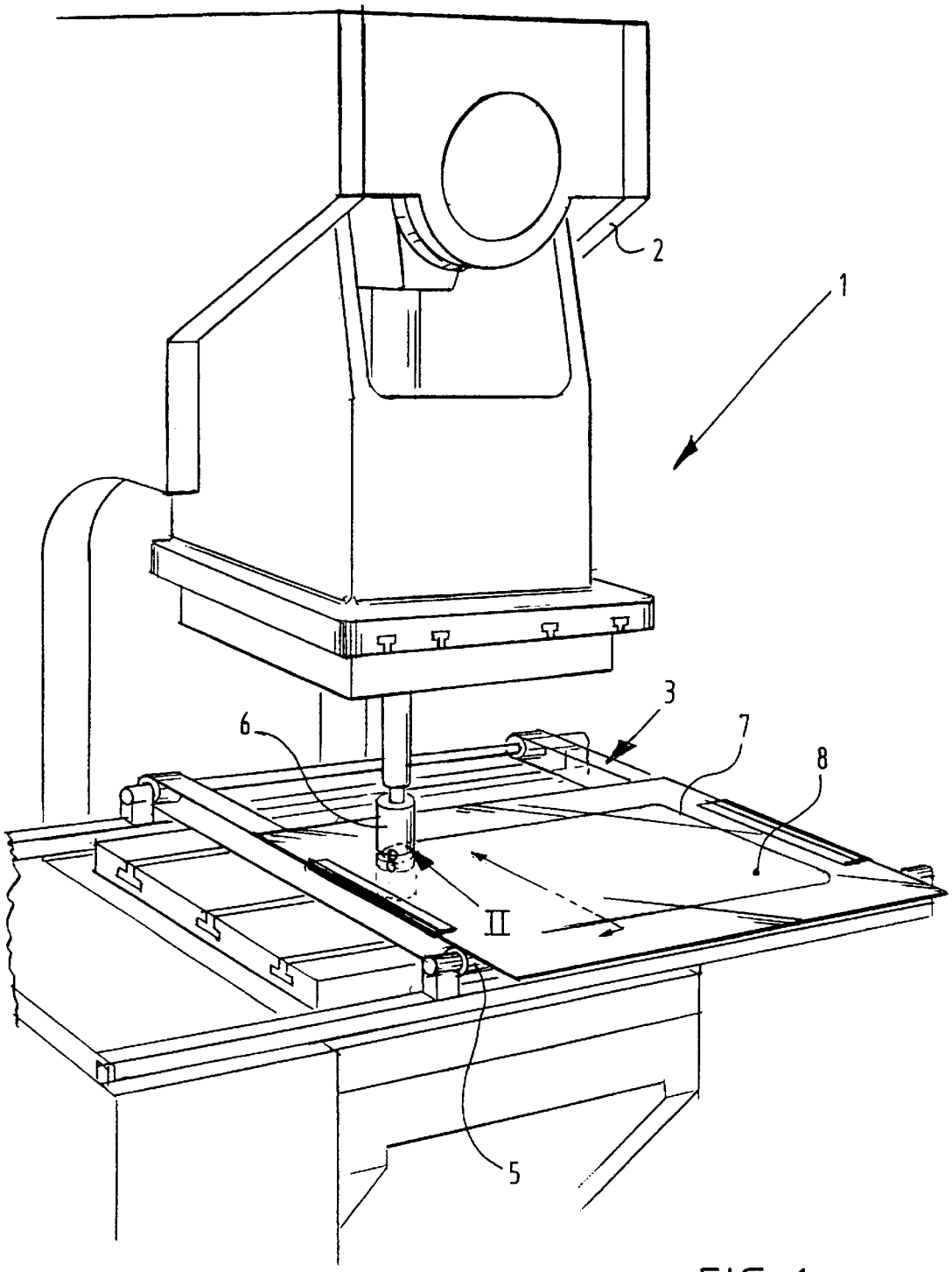

This application is a 371 of PCT/NL97/00150, filed Mar. 25, 1997.

The present invention relates to a method and a device for forming weakenings in a metal plate. Particularly the invention relates to a method, comprising of:

deforming the metal plate to a predetermined depth to form a weakening thinned portion along at least one line to bend the metal plate along the line subsequent to the method; and displacing relative to each other the metal plate and at least one pressure roller deforming the metal plate along the line and over at least one surface of the metal plate with a force directed substantially transversely of the metal plate and sufficient to deform the metal plate.

Such a method is known from the International patent application WO 95/19233, where the roller is ruled, punched, etc. into the material of the plate and the roller is placed centrally relative to a holder, to which the roller is connected. From this document also a device is known for machining metal plate, comprising: a frame; support means which are mounted on the frame and which define a supporting plane for a metal plate; at least one holder mounted on the frame and which is rotatable aroud an axis of rotation lying substantially transversely of the supporting plane, wherein the holder 25 carries a machining roller provided with a machining outer surface; moving means for displacing a metal plate on the support means relative to the holder. In the device the same considerations apply as hereinabove in relation to the method.

A disadvantage of the known device and the known method is, that in order to go through a tight turn in a line to be followed by the roller, e.g. a bend line, the process of following this line has to be interrupted, the roller has to be lifted from the plate and the holder, to which the roller is connected, has to be turned in order to redirect the roller in the desired direction, after which the roller can be brought back down on the surface of the metal plate. In this interruption alignment between the roller and the plate can change, whereby a resumption of the process may take place at another position than the end position of the machining prior to the interruption.

Moreover any interruption in automated machine processes is undesirable as a result of the loss of time that occurs and the complexity of the process, if it is interrupted frequently, increases to such an extent, that control of the processes is also complicated.

The invention has for its object to obviate at least an above mentioned drawback and provides for this purpose a method, which is distinguished by applying a swivel castor, having an axis of rotation, around which a pressure roller is rotatable, and a swivel axis, where the axis of rotation is essentially perpendicular to a swivel axis and where the swivel axis and the axis of rotation cross at a distance. Also according to the present invention a device is provided, which is distinguished in that the roller is mounted on the holder in a swivel castor configuration on a roller shaft crossing the axis of rotation at a distance.

According to the present invention it is possible to selectively pivot the pressure roller during displacement thereof. In this manner it is possible to weaken a metal plate by thinning along a straight and/or curved line with a very tight bend therein or at the end thereof. In preference however the method herein additionally comprises arresting the pivotability of the pressure roller when it is not in use, so that the pressure roller can be set into operation again in the same position as that wherein the pressure roller was previously rendered inoperative such that arranging of a line can be continued after a short interruption without there being any difference in the position of the pressure roller and without any discontinuity in the form of the weakening along the line. Other advantages of arresting the pivotability are described hereinbelow in relation to the figures. This step alternatively comprises pivoting the pressure roller to a starting position when it is not in use. In this way a new line can be initiated from the same starting position each time. This is then preferably a starting position relative to a rotating station of for instance a punch press or nibbling machine in which the tool is placed, wherein the rotating station itself is mounted for rotation on other components of the punch press or nibbling machine so as to be able to rotate relative thereto and thus be able to carry the pressure roller into any random desired position relative to the plate prior to starting the machining.

In a second embodiment a method according to the present invention comprises the step of repeated and substantially adjacent punching of segments of the line in the plate. In this manner a practically continuous thinned portion is arranged along the line and it is possible in very efficient manner to pass through even acute angles in the line during following thereof for the purpose of arranging the thinned portion. In preference the method herein comprises punching the bend line using a punch press or nibbling machine, wherein the punch is struck repeatedly and substantially adjacently in the metal plate to thus arrange deforming thinned portions along the line. The method herein preferably comprises punching along the bend lines with a wedge-shaped stamp as punch in order to form a groove of wedge-shaped cross section in the metal plate.

In another preferred embodiment a method according to the present invention comprises the step of displacing the metal plate and a combination of at least two tools relative to each other, of the tools moving along the bend line over a surface of the plate, and at least one being a swivel castor. In this manner the plate is machined from the upper side and the underside thereof in order to form the weakening thinned portion. The weakening thinned portions can herein be located directly opposite each other in the metal plate, but can also be arranged mutually parallel along the line.

The present invention further comprises a device for performing a method according to the present invention, in addition to a plate manufactured with a method or device according to the present invention.

Figure 2:
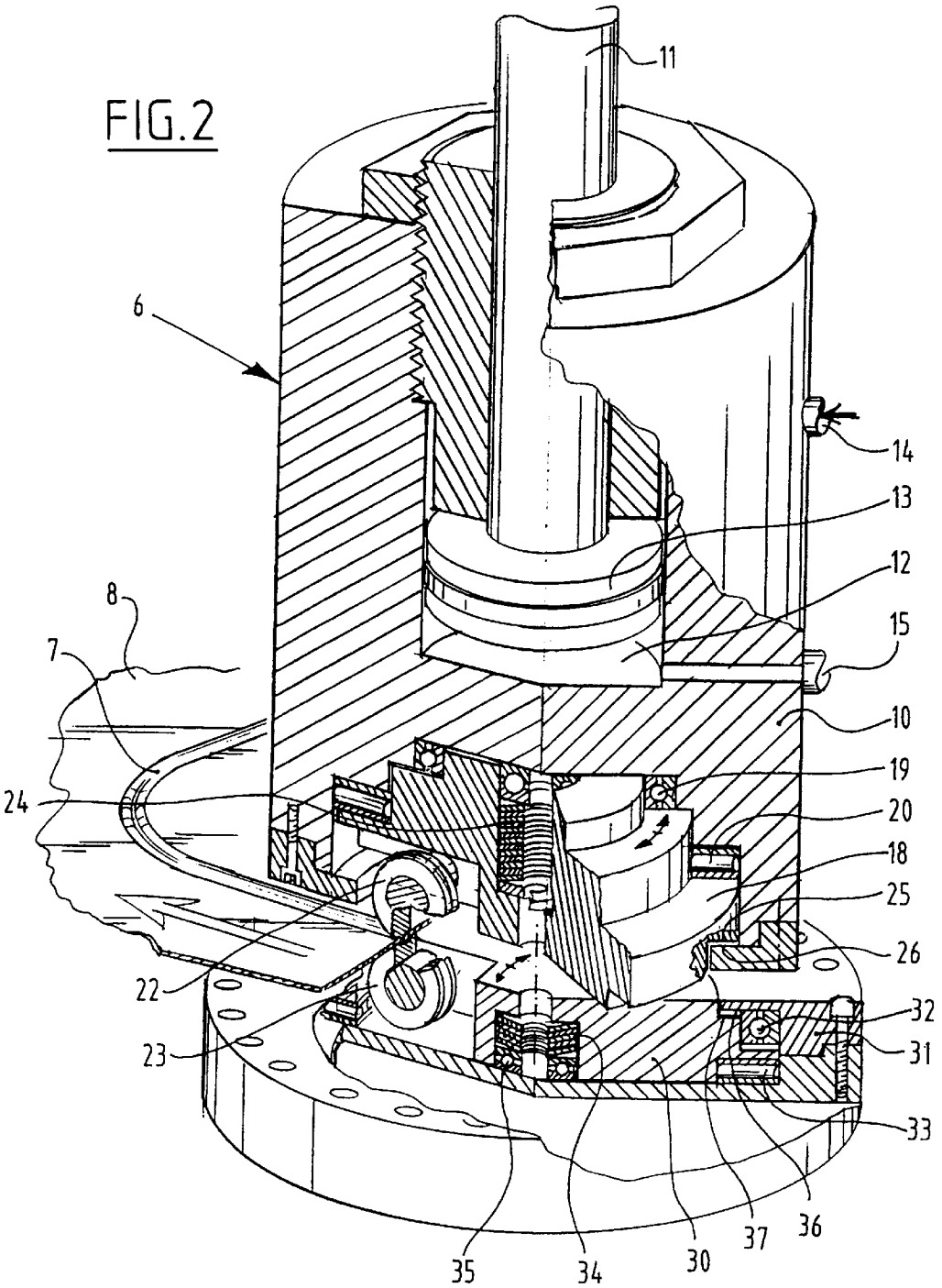
Figure 4:
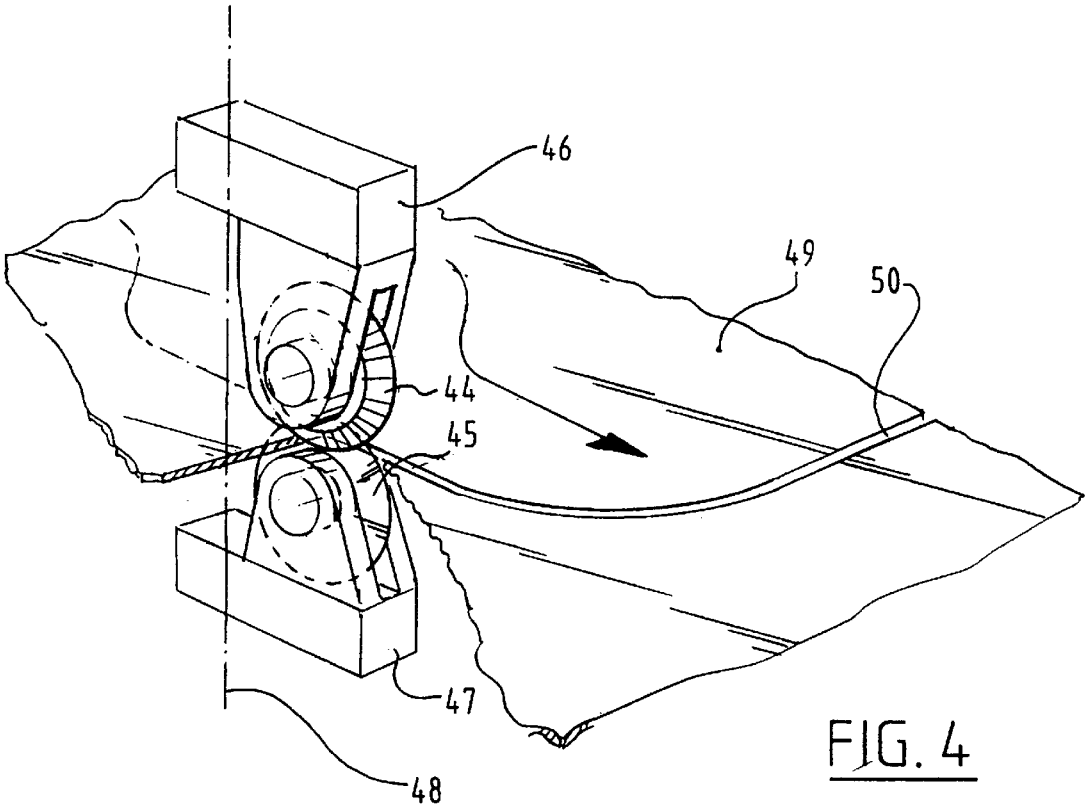
Figure 3:
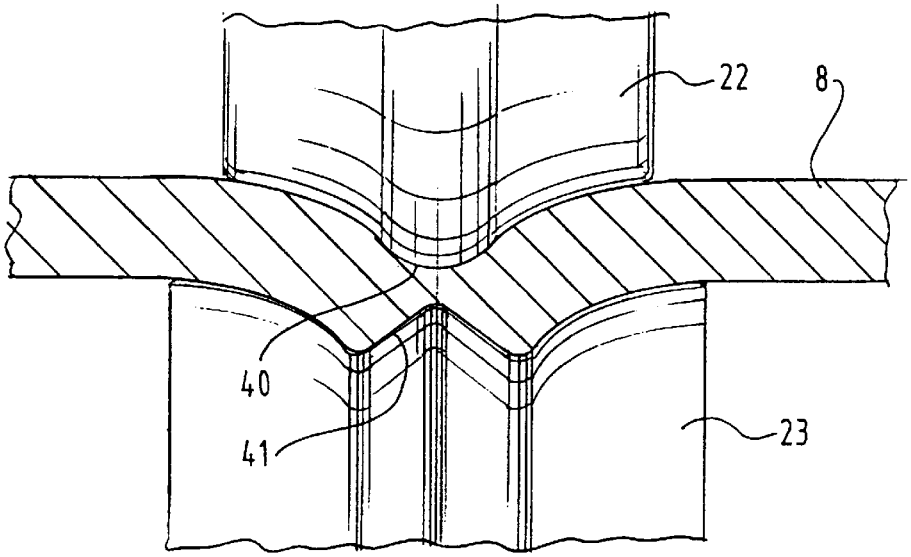
Figure 5:
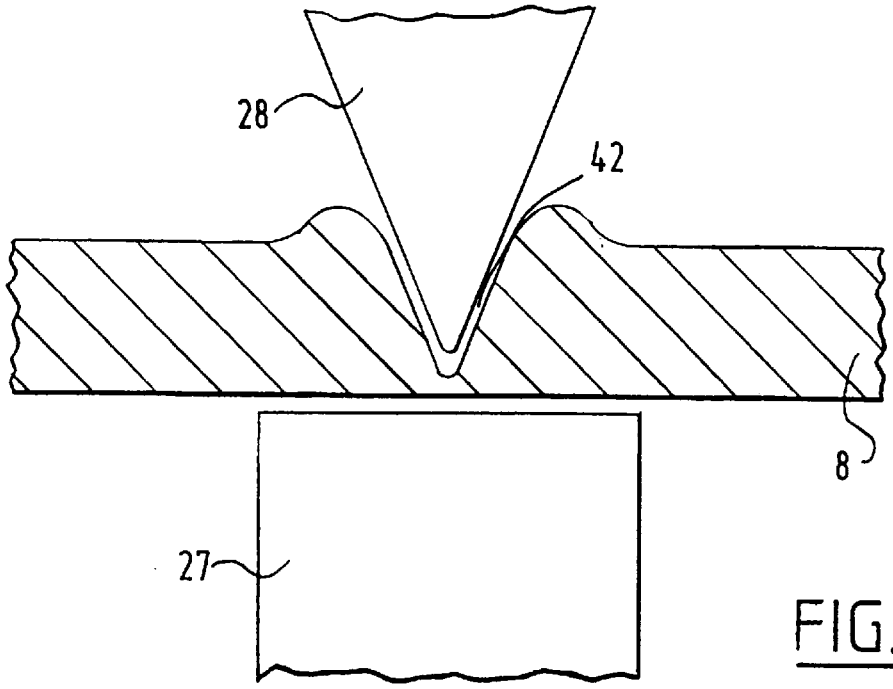
Figure 6:
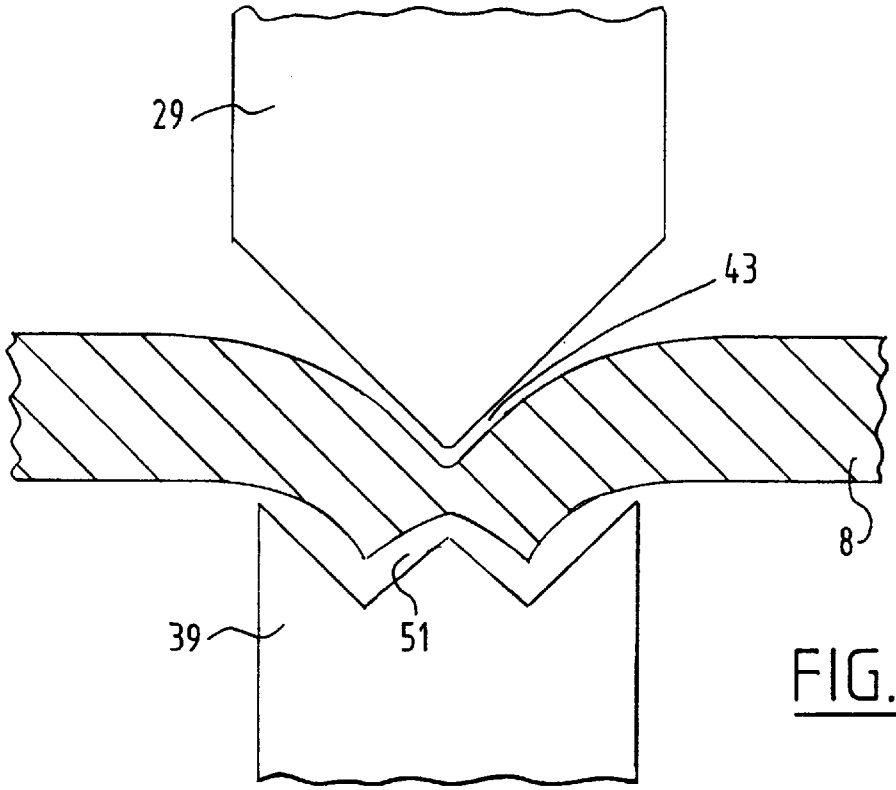

The invention will be further elucidated hereinbelow with reference to embodiments of devices for performing the method according to the present invention. In the drawing:

FIG. 1 shows schematically a device according to an embodiment of the invention, FIG. 2 shows a detail as according to arrow II in FIG. 1, FIG. 3 shows a view as according to III in FIG. 2, FIG. 4 shows a detail of an alternative embodiment, FIG. 5 shows a sectional side view of a plate in a first alternative device according to the present invention, and FIG. 6 shows a sectional side view of a plate in a second alternative device according to the present invention.

In the figures the same components are referred to with the same reference numerals.

The device 1 shown schematically in FIG. 1 comprises a frame 2 on which are mounted support means 3 for supporting a metal plate 8. In this schematic embodiment the support means 3 comprise a controlled X/Y drive 5, with which metal plate 8 can perform random programmable translation movements relative to a tool holder 6 of device 1.

The tool holder 6 comprises machining rollers to be further described with reference to FIG. 2, with which a profile 7 can be arranged in plate 8.

The actual machining tool is shown in FIG. 2 and comprises a holder 18 in which a first machining roller 22 is mounted and a holder 30 in which a second machining roller 23 is mounted. In device 1 the holders 18, 30 are mounted such that roller 23 is supported beneath metal plate 8 and roller 22 is supported above metal plate 8. Together they can form said profiling 7 in metal plate 8.

Holder 18 is received in a housing 10 for rotation round a vertical axis. Formed in the top of housing 10 is a hydraulic cylinder 12 in which a piston 13 is slidable, said piston being connected to a shaft 11. The housing 10 is mounted in device 1 with shaft 11. Use can of course be made alternatively of a pneumatic cylinder instead of hydraulic cylinder 12, or of other similar equipment.

Hydraulic cylinder 12 comprises two connections 14 and 15. By feeding oil under pressure to connection 14 this oil is carried above piston 13, whereby housing 10 moves upward relative to shaft 11. By feeding oil via connection 15 oil is carried under piston 13, whereby housing 10 is moved downward.

Holder 18 is mounted in housing 10 for rotation on said vertical axis by means of a radial ball bearing 19 In vertical direction holder 18 is enclosed in housing 10 in downward direction by means of a ring of housing 10 which engages beneath an edge of holder 18. The thereby formed co-acting contact surfaces 25, 26 on respectively holder 18 and housing 10 serve as arresting means for arresting holder 18 against rotation in housing 10.

Holder 18 is in fact urged downward by spring washers 24 relative to housing 10, i.e. toward the holder 30 located opposite. When housing 10 is moved upward, spring washers 24 will thus press contact surfaces 25, 26 with force against each other, whereby holder 18 is received non-rotatably in housing 10.

When holder 18 is pressed upward relative to housing 10, in particular because housing 10 is pressed downward such that the roller 22 thereof is pressed via metal plate 8 against the underlying roller 23, holder 18 will be moved slightly upward in housing 10 counter to the pressure of spring washers 24, such that the contact surfaces 25, 26 move apart and holder 18 becomes freely rotatable in housing 10. Holder 18 is therein supported in axially upward direction by an axial bearing 20.

The lower holder 30 is built up in substantially corresponding manner. Holder 30 is mounted rotatably in housing 31 by means of a radial ball bearing 32. Here also holder 30 is loaded by means of spring washers 34 which rest on one side against holder 30 and on the other side against an axial ball bearing 35.

When holder 30 can move freely upward under the influence of the force exerted by spring washers 34, a peripheral edge 37 thereof comes into contact with a peripheral edge 36 which is fixedly connected to housing 31. Holder 30 is hereby also arrested non-rotatably in housing 31.

When holder 30 is pressed downward in housing 31 counter to the force of spring washers 34, in particular because the upper machining roller 22 presses via metal plate 8 on the lower machining roller 23, the contact surfaces 36, 37 move apart, whereby holder 30 becomes freely rotatable in housing 31. The axial load on holder 30 can herein be absorbed by axial bearing 33.

As is clearly shown in FIG. 2, the machining rollers 22, 23 are mounted rotatably on roller shafts which intersect at a distance the axis on which holders 18, 30 are jointly rotatable.

When holder 10 is now pressed downward because oil under pressure is introduced under piston 13 via connection 15, metal plate 8 is clamped between machining rollers 22, 23 and the respective contact surfaces are released, whereby holders 18, 30 become freely rotatable.

When plate 8 is now displaced relative to the holders, the rollers 22, 23 will roll over plate 8 and therein press for instance a groove into plate 8. When plate 8 moves through a curved line relative to holders 18, 30 the rollers 22, 23 will cause holders 18, 30 to rotate due to a swivel castor effect, whereby rollers 22, 23 roll evenly in the curved path over plate 8. Holders 18, 30 do not therefore have to be rotated in controlled manner. Simply as a result of the relative displacements of metal plate 8 the holders 18, 30 adjust to the desired angle, wherein the transverse plane of the rollers 22, 23 extends parallel to the tangent to the described path.

When a machining with rollers 22, 23 is completed, i.e. when for instance the end of the groove to be formed has been reached, housing 10 is moved upward by supplying oil under pressure via connection 14. The spring washers 24 and 34 subsequently press holders 18 respectively 30 with their contact surfaces 25 respectively 37 against the oppositely located contact surfaces 26 respectively 38 of housings 10, 31, so that these holders 18, 30 are arrested against rotation. At the next machining, i.e. at the beginning of a following groove to be formed, when housing 10 is moved downward to press wheels 22, 23 with force toward each other, these wheels 22, 23 will thus be positioned accurately relative to each other, in accordance with the positioning they had at the end of the previous machining. No separate means are therefore required to align holders 18, 30 relative to each other.

FIG. 3 shows in more detail a possible embodiment of rollers 22, 23, wherein the co-acting outer surfaces of rollers 22, 23 are formed such that in the top surface of plate 8 a groove with gradually rising walls is formed, while in the underside of the plate a W-shaped groove is formed with likewise gradually rising walls. Such a profiling of plate 8 enables bending of the plate at the position of the grooves, wherein a uniform external rounding is obtained in the bent form. This also brings about centering of the two rollers 22 and 23 relative to each other on either side of the plate.

With the device according to the invention other rollers can also be used in addition to machining rollers such as machining rollers 22, 23 to press a special profile in the metal plate. FIG. 4 shows schematically an application wherein rollers 44, 45 are co-acting cutting rollers for arranging a cut 50 in plate 49. Rollers 44, 45 are here likewise mounted in holders 46, 47 which are rotatable round a common axis 48. The axes of rotation of rollers 44, 45 intersect this axis 48 at a distance, so that the desired "swivel castor action" is realized.

The co-acting machining rollers do not necessarily have to have substantially complementary profilings. When a groove has to be arranged in a metal plate, only the upper roller may for instance be provided with a radial protrusion, while the lower roller takes a wholly flat form. Other suitable profilings of course lie within the reach of the skilled person in the field.

As stated above, the device according to the invention can suitably be a punch press or nibbling machine. Housings 10, 31 are herein mounted for instance in co-acting stations of tool holders. The metal plate 8 is moved by the X/Y drive of the machine along a preprogrammed path relative to rollers 22, 23, wherein the desired machining will thus take place along this path by the outer surfaces of rollers 22, 23.

It will be apparent herein that the path for the movements to be performed, which is to be programmed in the usual manner, is not exactly the path which is described by rollers 22, 23 relative to metal plate 8. The path to be programmed defines the position of the central axis of housings 10, 31 relative to metal plate 8, while the contact location of rollers 22, 23 lies at a distance therefrom. It is however simple for any skilled person in the field to appreciate how the programming of the movements of the device must be performed in order to cause the machining to take place according to a desired path in metal plate 8.

In the device according to the invention the holders can also be mounted in suitable manner for controlled rotation in the device, so that they can be placed at the suitable angular position each time a machining is initiated. This particularly applies in the case of a punch press or nibbling machine when the housings with the holders mounted therein are accommodated in a rotating station of this machine. All the required control means for placing the holders in the desired angular position are then already present in this machine.

It is noted that although in the described preferred embodiment the pressing force for pressing the machining rollers toward each other is generated in the tool itself, by means of the piston/cylinder construction, this force can of course also be generated in the machine itself, wherein the tool can thus take a simpler form.

FIG. 5 shows a cross-sectional view of a plate 8 for machining and a punch press or nibbling machine, of which only a punch designed as a stamp 28 and a support block 27 are shown. Stamp 28 and/or support block 27 are preferably arranged in a rotating station of the punch press or nibbling machine, wherein this rotating station is preferably also rotatable relative to the other components of the punch press or nibbling machine. This enables adjustment of the stamp in random positions relative to the plate and/or the other components of the punch press or nibbling machine.

Support block 27 and stamp 28, which has limited dimensions in the longitudinal direction of the line along which plate 8 is later folded, each form part of the punch mechanism, the other parts of which are not shown here. Support block 27 and stamp 28 are situated practically in the extreme position thereof during a stroke of the punch press or nibbling machine wherein a groove 42 is arranged in plate 8. At each stroke of the punch press or nibbling machine a segment of the groove 42 is formed along the line under the deforming influence of substantially the stamp 28 during the stroke. The plate is then shifted, wherein a side edge of stamp 28 abuts in longitudinal direction of the line and on the rear thereof relative to the direction of displacement to the end of the groove 42 formed up to that point, or overlaps it, whereafter a new stroke is started.

Support block 27 is designed in this figure as a counter-stamp moveable in a direction opposed to that of stamp 28, but can alternatively be formed by a stationary support surface or the like. It is also possible for the support block to comprise a separate stamp with a form corresponding with that of the stamp 28 at the top of the figure and in an opposing direction.

FIG. 6 shows a cross section corresponding with FIG. 5 of plate 8, which is however machined with an alternative punch press or nibbling machine. The punch press or nibbling machine shown here comprises a punch mechanism with a drive (not shown) and an alternative, blunter stamp 29 as punch. A groove 43 formed with this stamp 29 is therefore wider on the surface of plate 8 shown at the top than the groove 42 shown in FIG. 5 formed with the sharper punch 28.

The device here also comprises a counter-stamp 39 as in the situation shown in FIG. 5. The counter-stamp 39 does however have the same W-shape as the outer surface of the roller 23 shown in FIG. 3. With this counter-stamp 39 a second groove 51 is formed in the surface lying opposite groove 43. In terms of the effects hereof, the same applies as already noted in respect of FIG. 3.

In contrast to the situation shown in FIG. 3, where rollers 22 and 23 are displaced over the surface of plate 8, stamp 29 and counter-stamp 39 make a stroke and are subsequently displaced along the line along which plate 8 is later bent, this over a distance corresponding to the width of at least the stamp 29, in order to abut at the following stroke onto the groove 43 formed up to that point, or to overlap to a certain extent the end thereof in longitudinal direction of the line.

As already remarked in respect of FIG. 5, it is also the case for FIG. 6 that stamp 29 and counter-stamp 39 are shown in practically extreme positions thereof. The depth to which the grooves respectively 42, 43 formed with stamps 28 and 29 extend is predetermined. A number of means may be used for this purpose. One of these is the use of arresting which acts mechanically on stamps 28 and 29 and/or on counter-stamps respectively 27 and 39. The arresting, for instance a cam (not shown) engaging stamps 28 and 29 and/or counter-stamps respectively 27 and 39, herein makes impossible a deeper penetration into the material of plate 8 than is shown here in FIG. 5 and 6. Alternatively, the punch mechanism, of which only stamps 28 and 29 and counter-stamps respectively 27 and 39 are shown and not the drive therefor, is provided with a control for adjusting a striking force of the stamps to be generated by the drive. Many other possible alternatives of the arresting will be apparent to a skilled person on the basis of the foregoing description thereof. The same applies for the method and device according to the present invention.

I claim:

1. Method for forming weakenings in a metal plate, comprising of:

deforming the metal plate to a predetermined depth to form a weakening thinned portion along at least one line to bend the metal plate along the line subsequent to the method; and displacing relative to each other the metal plate and at least one pressure roller deforming the metal plate along the line and over at least one surface of the metal plate with a force directed substantially transversely of the metal plate and sufficient to deform the metal plate, characterized by applying a swivel castor, having an axis of rotation, around which a pressure roller is rotatable, and a swivel axis, where the axis of rotation is essentially perpendicular to a swivel axis and where the swivel axis and the axis of rotation cross at a distance.

2. Method as claimed in claim 1, characterized by arresting the pivotability of the pressure roller when it is not in use.

3. Method as claimed in claim 1, characterized by pivoting the pressure roller to a starting position when it is not in use.

4. Method as claimed in claim 1, characterized by repeated and substantially adjacent punching of segments of the line in the metal plate.

5. Method as claimed in claim 1, characterized by punching the line using a punch press or nibbling machine.

6. Method as claimed in claim 4, characterized by punching along the lines with a wedge-shaped stamp.

7. Method as claimed in claim 1, characterized by displacing the metal plate and a combination of at least two tools relative to each other, each of the tools moving along the bend line over a surface of the plate, and at least one being a swivel castor.

8. Device for machining metal plate, comprising: a frame; support means which are mounted on the frame and which define a supporting plane for a metal plate; at least one holder mounted on the frame and which is rotatable aroud an axis of rotation lying substantially transversely of the supporting plane, wherein the holder carries a machining roller provided with a machining outer surface; moving means for displacing a metal plate on the support means relative to the holder, characterised in that the roller is mounted on the holder in a swivel castor configuration on a roller shaft crossing the axis of rotation at a distance.

9. Device as claimed in claim 8, where the holder is freely rotatable on the axis in a machining position.

10. Device as claimed in claim 8, comprising arresting means for arresting the holder in a rotation position.

11. Device as claimed in claim 9, wherein the holder is axially displaceable along the common axis in order to enable displacing of the machining roller between a machining position proximal to said supporting plane and a rest position distal from said supporting plane and the arresting means enter into operation when the roller is moved from the machining position into the rest position.

12. Device as claimed in claim 11, wherein the holder is mounted on a housing for axial displacement and for rotation around the axis, the arresting means comprise co-acting contact surfaces on the housing and the holder which, in an end position of the holder proximal to the supporting plane come into engagement and the holder is urged by biasing means in the direction of the supporting plane.

13. Device as claimed in claim 12, wherein the biasing means comprise spring-mounted means.

14. Device as claimed in claim 12, wherein the spring-mounted means comprise spring washers.

15. Device as claimed in claim 8, wherein the holders are arranged in co-acting tool carriers of a punch press or nibbling machine.

* * * * *